US006579656B2

(12) United States Patent
Fehervari et al.

(10) Patent No.: US 6,579,656 B2
(45) Date of Patent: Jun. 17, 2003

(54) HALF ESTERS OF ISOBUTYLENE/MALEIC ANHYDRIDE COPOLYMER AS ATTENUATORS OF PHOTOGRAPHIC FILM DEVELOPMENT

(75) Inventors: Agota F. Fehervari, Lexington, MA (US); William L. Grimm, Lancaster, PA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 09/896,690

(22) Filed: Jun. 29, 2001

(65) Prior Publication Data

US 2003/0039855 A1 Feb. 27, 2003

(51) Int. Cl.[7] ..... G03C 8/52; G03C 1/76

(52) U.S. Cl. ..... 430/216; 430/227; 430/237; 430/248; 430/428; 430/432; 430/536

(58) Field of Search ..... 430/216, 536, 430/227, 237, 248, 432, 428

(56) References Cited

U.S. PATENT DOCUMENTS

| | | | | | |
|---|---|---|---|---|---|
| 3,362,819 | A | * | 1/1968 | Land | 430/216 |
| 4,153,458 | A | * | 5/1979 | Iguchi et al. | 430/627 |
| 4,267,262 | A | * | 5/1981 | Karino et al. | 430/215 |
| 5,541,046 | A | | 7/1996 | Cottrell | 430/507 |
| 5,861,237 | A | | 1/1999 | Takaki | 430/532 |

FOREIGN PATENT DOCUMENTS

| | | | |
|---|---|---|---|
| JP | 51-144610 | 12/1976 | G03C/1/04 |

* cited by examiner

*Primary Examiner*—Richard L. Schilling

(57) ABSTRACT

A photographic film with a polymeric acid-reacting neutralizing layer comprising a half ester of isobutylene/maleic anhydride copolymer is provided herein. This polymeric acid-reacting neutralizing layer is used to attenuate a photographic film's development process, which is effective under alkali conditions, by lowering the pH of the alkaline processing composition.

15 Claims, 3 Drawing Sheets

↑
10

HALF ESTERS OF ISOBUTYLENE/MALEIC ANHYDRIDE COPOLYMER AS ATTENUATORS OF PHOTOGRAPHIC FILM DEVELOPMENT

FIELD OF THE INVENTION

This invention pertains to the synthesis and use of copolymers employed in the processing of photographic film. Specifically, the instant invention discloses half esters formed using an isobutylene/maleic anhydride copolymer used to terminate the development of photographic film.

BACKGROUND OF THE INVENTION

In general, diffusion transfer photographic products and processes involve film units having a photosensitive element including a support carrying at least one silver halide emulsion, and an image-receiving element including a support and an image-receiving layer. After photoexposure, the photosensitive element is developed, typically by uniformly distributing an alkaline processing composition over the photoexposed element, to establish an imagewise distribution of a diffusible image-providing material. The image-providing material, (e.g., image dyes or complexed silver), is selectively transferred, at least in part, by diffusion to the image-receiving layer positioned in a superposed relationship with the developed photosensitive element. The image-receiving layer is capable of mordanting or otherwise fixing the image-providing material and retains the transferred image for viewing. The image is viewed in the image-receiving layer upon separation of the image-receiving element from the photosensitive element after a suitable period. Black and white transfer images are generally formed by exposing and developing a silver halide emulsion, and subsequently dissolving and transferring silver from unexposed, or less exposed regions, to an image-receiving layer containing silver precipitating agents or nuclei. The transferred silver is reduced to metallic silver in the image-receiving layer, thus forming an image. Color images are generally formed by the imagewise transfer of image dyes from a photosensitive element to an image-receiving layer containing a dye mordant material.

In photographic film units, a strip-coat (also referred to as a "stripping layer" or "release layer"), is commonly positioned between the photosensitive element and an image-receiving element to facilitate the separation of the elements from one another after processing. In photographic applications, strip-coats may additionally serve to prevent processing solution from remaining on the image-receiving element after processing. A specific example of such a strip-coat is provided in U.S. Pat. No. 5,346,800 to Foley et al. that describes a strip-coat comprising a hydrophilic colloid.

Some photographic film units incorporate an overcoat layer. This overcoat layer can serve to facilitate separation between an image-receiving element from a photosensitive element. This layer can comprise one or more polymeric materials like polyvinyl alcohol. In some embodiments the overcoat layer can serve functionally as a strip coat.

Image-receiving elements particularly adapted for use in peel-apart diffusion transfer film units include an image-receiving layer for retaining the transferred image. This image-receiving layer is typically arranged on a substrate layer of suitable material or a combination of layers arranged on the substrate layer. In one well known photographic embodiment, the image-receiving element comprises a support material (preferably, an opaque support material carrying a light-reflecting layer for the viewing of the desired transfer image thereagainst by reflection); a polymeric acid-reacting (neutralizing) layer adapted to lower the environmental pH of the film unit subsequent to substantial transfer image formation; a spacer (or timing) layer adapted to slow the diffusion of the alkali of an aqueous alkaline processing composition toward the polymeric neutralizing layer; and an image-receiving layer to receive the transferred photographic image. Such a structure is described, for example, in U.S. Pat. No. 3,362,819 and is illustrated in other patents, including U.S. Pat. Nos. 4,322,489 and 4,547,451.

The polymeric acid-reacting layer is used to neutralize the alkaline developing solution or reagent. Currently, the butyl half ester of ethylene/maleic anhydride copolymer (EMA) is used for the neutralizing layer. The half ester of EMA is effective in reducing the pH of the developing solution so as to effectuate the termination of the development process. However, there is a desire to increase manufacturing efficiency. For example, it is desirable to directly coat the film unit with the neutralizing layer immediately following its synthesis without any intervening steps. Additionally, it is desirable to form a neutralizing layer in which the functional groups of the polymer are fully converted such that available residual anhydride groups are minimized. Furthermore, it is also desirable that the coating solution of the neutralizing layer be stable and constant in terms of acid content and viscosity. These goals however must comport with the commercial goals of a particular business enterprise. Therefore, the substrates employed for making the neutralizing layer must be readily available and be economically favorable.

SUMMARY OF THE INVENTION

The present invention pertains to a polymeric neutralizing layer within a photographic film used to attenuate the development of the film. The development of film utilizes an aqueous alkaline development processing solution, or reagent. In order to arrest the development process, a polymeric acid-reacting neutralizing layer neutralizes the alkaline processing solution. Diffusion of the aqueous alkaline processing solution is facilitated by the dissolution of a timing layer that serves as a barrier between the polymeric acid-reacting neutralizing and image receiving layers. In the present invention, the neutralizing layer comprises an acidic polymer. This acidic polymer, when in contact with the alkaline processing solution, neutralizes the base, shifting the pH thus attenuating further development of the photographic film.

The present invention provides a polymeric neutralizing layer comprising, among other features, a half ester of isobutylene/maleic anhydride copolymer, hereinafter referred to as "IBMA." In one embodiment, the esterification of IBMA leads to a propyl half ester of IBMA. In another embodiment, the esterification reaction produces a butyl half ester. Other half esters are also envisaged to be within the scope of this invention, such as alkyl half esters containing approximately 1 to 12 carbon atoms in a normal or branched alkyl chain. The alkyl chain can contain groups like hydroxyl, halogen, phenyl, substituted phenyl as well as aryl or substituted aryl half esters, containing substituents like hydroxyl, halogen and alkyl containing about 1 to 4 carbon atoms in a linear or branched structure.

The esterification of IBMA involves the dispersion of the IBMA substrate in an appropriate alcohol. During the esterification process, the alcohol reactant opens the anhydride ring and forms an ester with one carboxylic group, while the remaining carboxylic acid group contributes the acid moiety to the polymer. For example, in the synthesis of propyl half ester of IBMA, n-propanol is the alcohol substrate and the acidic moiety is released from the cyclic anhydride by the reaction of the other carboxylic group with the alcohol. The IBMA/alcohol admixture is heated to a reflux temperature appropriate for the alcohol used and refluxed for several hours. As the esterification reaction progresses, the polymer slowly becomes swollen in the boiling alcohol, passes through a swollen gel state, and then starts to dissolve within the alcohol. As the reaction nears completion, a fine dispersion becomes clear and colorless. The progress of the reaction can be followed using different detection techniques, including infrared ("IR") detection.

BRIEF DESCRIPTION OF THE DRAWINGS

The invention will be more fully understood by reference to the following detailed description when considered in conjunction with the accompanying drawings, in which.

DETAILED DESCRIPTION OF THE INVENTION

Figure 1:
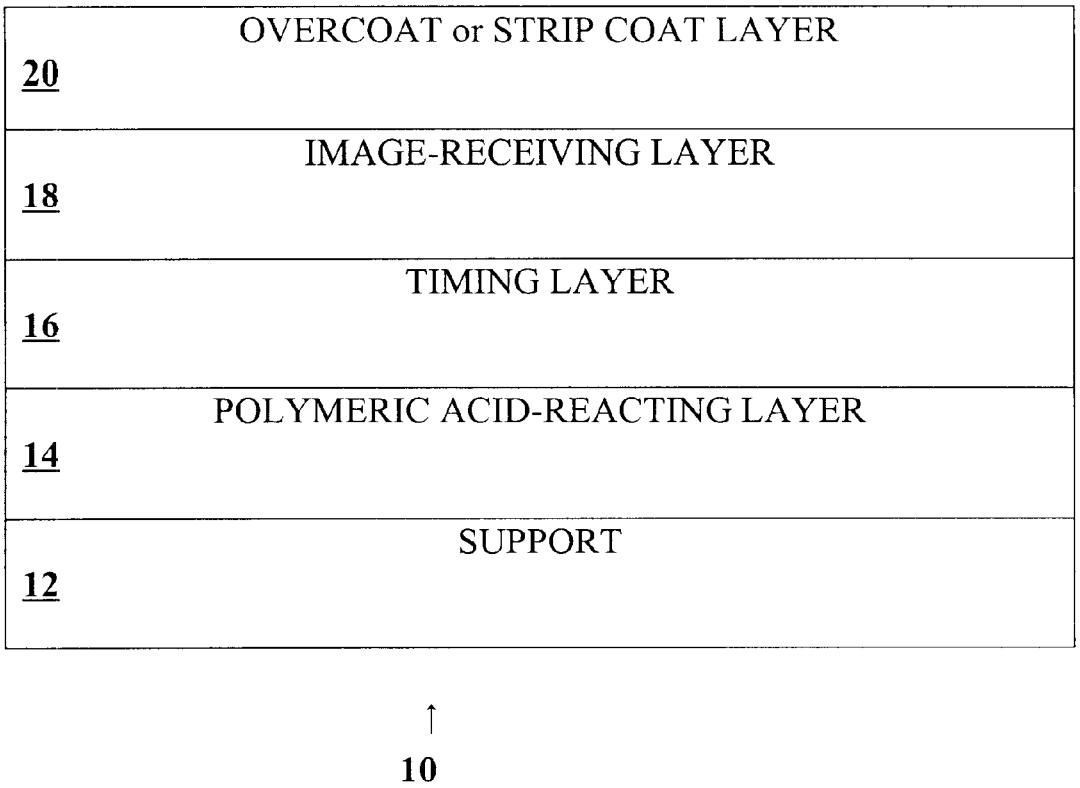
FIG. 1 is a partially schematic, cross sectional view of one embodiment of an image-receiving element according to the invention.

The present invention pertains to a polymeric layer within a photographic film used to terminate photographic development. In photographic film, e.g., instant, film, the development of an image involves employing an alkaline processing composition that is active under alkaline conditions. In order to arrest the development process, an acidic neutralizing polymeric layer interacts with and neutralizes this alkaline processing composition by lowering the pH of the alkaline processing composition, resulting in the attenuation of further image development. This invention provides different polymers that can be employed to neutralize the alkaline processing composition.

Photographic film, particularly instant and peel-apart film, has an image-receiving element 10 which comprises a support 12 carrying a polymeric acid-reacting (neutralizing) layer 14, a timing (or spacer) layer 16, an image-receiving layer 18 and a strip coat (or overcoat, depending upon the particular embodiment) layer 20. See FIG. 1. Each of the layers carried by the support 12 functions in a predetermined manner to provide desired diffusion transfer processing. It should be understood that the image-receiving element can include additional layers as known in the art.

Support material 12 can comprise any of a variety of materials capable of carrying layers 14, 16, 18, and 20, as shown in FIG. 1. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, support material 12 may be transparent, opaque or translucent. Typically, an image-receiving element adapted to be used in peel-apart diffusion transfer film units and designed to be separated after processing will be based upon an opaque support material 12. While support material 12 of image-receiving element 10 will preferably be an opaque material for producing a photographic reflection print, it will be appreciated that support 12 will be a transparent support material where the processing of a photographic transparency is desired. For example, where the image-receiving element 10 is desirably utilized in the manufacture of photographic diffusion transfer units, where the desired image will be viewed through a support, the support 12 will be of a transparent material. See U.S. Pat. No. 5,561,190, the entire teaching of which is incorporated herein by reference. In one embodiment where support material 12 is a transparent sheet material, an opaque sheet (not shown), preferably pressure-sensitive, can be applied over the transparent support to permit in-light development.

In the embodiment illustrated in FIG. 1, the image-receiving element 10 includes a polymeric acid-reacting layer 14, timing layer 16 and image-receiving layer 18. The polymeric acid-reacting layer 14 reduces the environmental pH of the film unit subsequent to transfer image formation. As disclosed, for example, in the previously referenced U.S. Pat. No. 3,362,819, the polymeric acid-reacting layer may comprise a nondiffusible acid-reacting reagent adapted to lower the pH from a first (high) pH of a processing composition, in which the image material (e.g., image dyes) is diffusible, to a second (lower) pH at which they are not diffusible.

Some embodiments employ a neutralizing system, for example, the invention described in U.S. Pat. Nos. 5,561,190; 5,427,899; and 5,455,148, the teachings of which are incorporated herein by reference. In one particular embodiment, the film structure comprises a timing layer that is not adjacent to an image-receiving layer, rather, it is adjacent to a photosensitive element, since both the neutralizing system as well as the timing layer is coated under the negative. This neutralizing system comprises two components, an aqueous neutralizing layer and a barrier neutralizing layer, which in the present context, is the IBMA alkyl half ester coated out of a solvent.

The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and polymeric acid reacting layer 14 which comprises immobilized acid-reactive sites.

Typically, the base neutralizing polymeric layer comprises acidic residues. These acidic residues provide the necessary chemistry to affect a pH change so as to neutralize the alkali development process. The neutralization layer is comprised of acidic polymeric molecules. These polymeric molecules can have the same or different molecular units. Blends of polymers can be used to effectuate a neutralization layer. The different polymeric units can be crosslinked using techniques well known to those skilled in the art. However, one important feature must be present in any neutralizing layer which is that it must consist of moieties that will neutralize the alkaline processing composition following the image development process. This is consistent with the requirement for acidic residues.

Maleic anhydride polymers are useful in the present invention for introducing functional groups or crosslinking. The anhydride group is readily opened by reacting it with an amine or alcohol thereby forming an amide or ester, respectively. In one embodiment of the present invention, an anhydride molecule is reacted with an alcohol forming a half ester product. Moreover, a carboxylic acid group is elaborated when the anhydride is treated with an alcohol, thus, contributing to the overall acid content of the polymer. The acid content is generally expressed in units of acid milliequivalents per gram of polymer (meq/g). Using a maleic anhydride molecule, the desirable theoretical value for acid content is between 2–7 meq/g which assumes one acid, e.g., carboxylic acid, and one ester group in each maleic monomer unit of the polymer. It is this carboxylic acid moiety in the esterified anhydride that neutralizes the alkaline processing composition. Preferably, the acid content of the copolymer neutralizing layer is sufficient to change the pH from about 13 to about 7.

In the present invention, alternating copolymers of maleic anhydride are used to construct the neutralization layer. The neutralization layer preferably has a molecular weight ranging from about 50,000 to about 2,000,000 dalton. In one embodiment, isobutylene/maleic anhydride copolymer is used to construct the base neutralizing layer. IBMA can be reacted with an alcohol to form a half ester. The alcohol can be a saturated or unsaturated hydrocarbon molecule, and may contain aromatic groups. Additionally, the alcohol can have between 1 and about 12 carbons. Moreover, the alcohol can be branched or unbranched. Also, the alcohol can be a polyalcohol containing multiple hydroxyl or halogen groups. Once the alcohol is reacted with the IBMA a half ester is formed. The resulting half ester product comprises an acid moiety that will neutralize the alkaline processing composition following the film development process.

In one embodiment of the present invention, a propyl half ester of the copolymer IBMA is used as the neutralizing layer. This propyl half ester is formed by reacting IBMA with n-propanol. In another embodiment, butyl half ester of the copolymer IBMA is employed as the neutralizing layer. The butyl half ester is formed by reacting IBMA with n-butanol. Other half esters are also envisaged to be within the scope of this invention by reacting IBMA with an alcohol other than propanol or butanol, such as ethanol, pentanol, hexanol, ethylhexyl alcohol, isopropanol, isobutanol, and alike.

The esterification of IBMA involves the dispersion of IBMA in an appropriate alcohol. The appropriate alcohol determines the ester moiety of the polymer, and releases the second carboxylic group, which provides the acidic moiety of the polymer. For example, in the synthesis of propyl half ester IBMA, n-propanol would be an appropriate alcohol. Likewise for the butyl half ester IBMA, n-butanol would be an appropriate alcohol to be employed. The IBMA/alcohol admixture is heated to a reflux temperature (determined by the alcohol used) and refluxed for several hours. As the esterification reaction progresses, the polymer slowly becomes swollen in the boiling alcohol, passes through a swollen gel state, and then starts to dissolve within the alcohol. As the reaction nears completion, a fine dispersion becomes clear and colorless. The progress of the reaction can be followed using, e.g., infrared detection techniques.

The timing layer 16 of the photographic film controls the initiation and the rate of capture of alkali by the polymeric acid-reacting layer 14 and can operate in a number of ways as has been described in the art. Hold-release timing layers are useful for the film units of the present invention. A particularly preferred material for use in timing layer 16 is a pentapolymer of diacetoneacrylamide, butyl acrylate, methyl methacrylate, carbomethoxymethyl acrylate and acrylic acid.

The image-receiving layer 18 is designed for receiving an image-forming material that diffuses in an imagewise manner from the photosensitive element during processing. The image-receiving layer can include a crosslinkable material which is crosslinked by a borate compound that can be delivered during processing (typically under alkaline conditions, e.g., pH values higher than 9 and often higher than 12) as is described in U.S. Pat. No. 5,593,809, the entire teaching of which is incorporated by reference herein. A particularly preferred material for use in image-receiving layer 18 comprises a polyvinyl alcohol binder (crosslinkable) material and a terpolymer mordant material as shown in columns 8 and 9 of U.S. Pat. No. 5,591,560, the entire teaching of which is incorporated by reference herein.

Many different materials that can be employed for the timing layer and the image-receiving layer are known in the art as are techniques for forming such layers. See, for example, U.S. Pat. Nos. 5,591,560 and 5,561,190.

In one embodiment, the film unit comprises a strip-coat layer 20 that facilitates the separation of an image-receiving element 10 from a photosensitive element. See FIG. 1. For example, in a photographic film unit which is processed by distribution of an alkaline processing composition between the image-receiving element 10 and a photoexposed photosensitive element, the strip-coat layer serves to facilitate separation of the photograph from a developed photosensitive system, and processing composition.

In another embodiment, the film unit comprises an overcoat layer 20. See FIG. 1. This overcoat layer is used to facilitate the separation of an image-receiving element from a photosensitive element. Moreover, the overcoat layer 20 can effectively function as a strip coat layer, as discussed above, see U.S. Pat. No. 5,561,190.

The half esters of IBMA of the present invention can be used in film units intended to provide multicolor dye images. The most commonly employed negative components for forming multicolor images are of the "tripack" structure and contain blue-, green-, and red-sensitive silver halide emulsion layers, each having associated: therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163; in U.S. Pat. No. 2,983,606; and in U.S. Pat. No. 4,322,489, the entire teachings of which are incorporated by reference herein. Photosensitive elements that include dye developers and a dye-providing thiazolidine compound can be used with good results and are described in U.S. Pat. No. 4,740,448 to P.O. Kliem, the entire teaching of which is incorporated by reference herein.

It should be understood by those skilled in the art, that the half esters of IBMA of the present invention may be used in film units other than those specifically described herein. For example, the diffusion transfer photographic film unit described in Japanese patent application S61-252685, filed Oct. 23, 1986 (the entire disclosure of which is incorporated by reference herein), is formed by placing a photosensitive element on a white supporting structure which is made up of at least: a) a layer having a neutralizing function; b) a pigment-receiving layer; and c) a peelable layer. The neutralizing layer can comprise half esters of IBMA as described herein. The photosensitive element includes at least one silver halide emulsion layer associated with an image dye-providing material, an alkaline developing substance containing a light-shielding agent and a transparent cover sheet. One of the half esters of IBMA, preferably, propyl half ester, can be employed to neutralize the alkaline developing process. Similarly, the subject invention may also be used in a peel apart film unit as described in U.S. Patent No. 5,023,163, the entire teaching of which is incorporated by reference herein.

The half esters of IBMA of the present invention are also applicable to black and white photographic film units. In such embodiments, a photosensitive element including a photosensitive silver halide emulsion is exposed to light and subject to an aqueous alkaline solution comprising a silver halide developing agent and a silver halide solvent. The developing agent reduces exposed silver halide to metallic silver and the solvent reacts with un-reduced silver halide to form a soluble silver salt complex. This soluble silver salt complex migrates to an image-receiving element. The image-receiving element typically comprises a support and an image-receiving layer including a silver precipitating material wherein the soluble silver salt complex is precipitated or reduced to form a visible silver "black and white" image. The binder material for the overcoat layer in black and white embodiments should be permeable to the photographic alkaline processing fluid and to complexed silver salt that transfers to the image-receiving layer to provide an image. The half esters of IBMA, preferably propyl half ester, can be used to neutralize the alkaline-based development process. Examples of such black and white photographic film units are disclosed in U.S. Pat. Nos. 3,567,442; 3,390,991; and 3,607,269, and in E. H. Land, H. G. Rogers, and V. K. Walworth, in J. M. Sturge, ed., *Neblette's Handbook of Photography and Reprography*, 7th ed., Van Nostrand Reinhold, New York, 1977, pp. 258–330, the entire teachings of which are incorporated by reference herein.

The invention will now be further described with respect to a specific preferred embodiment by way of an example, it being understood that this is intended to be illustrative only and the invention is not limited to the materials, conditions, process parameters, etc. recited therein.

EXAMPLE

Formation of Propyl or Butyl Half Ester of IBMA Copolymer

The propyl half ester of IBMA copolymer was synthesized according to the following procedure. The esterification reaction involved the dispersion of IBMA in an appropriate alcohol. This alcohol contributes an acid moiety to the copolymer. In this example, n-propanol was the alcohol used. In a typical procedure, 5.51 kg of IBMA is dispersed in 19.92 kg of n-propanol. The IBMA/alcohol admixture was heated to the reflux temperature of n-propanol, about 90° C. to about 125° C. (depending upon the conditions) and refluxed for several hours (approximately 5 to 15 hours, depending upon the conditions). As the esterification reaction progressed, the polymer slowly became swollen in the boiling alcohol, then passed through a swollen gel state, and finally started to dissolve within the alcohol. As the reaction neared completion, a fine dispersion became clear and colorless.

Generally, the esterification of the IBMA using n-propanol requires a total reaction time of about 14 hours when carried out under atmospheric pressure at the n-propanol reflux temperature. In order to increase the reaction rate, a Mettler RC-1 was used. The RC-1 is a Hastalloy pressure vessel capable of handling the higher temperature and pressure required for increased reaction rates. The reactor used was opaque, therefore, the course of the reaction was monitored using an infrared probe.

Figure 2:
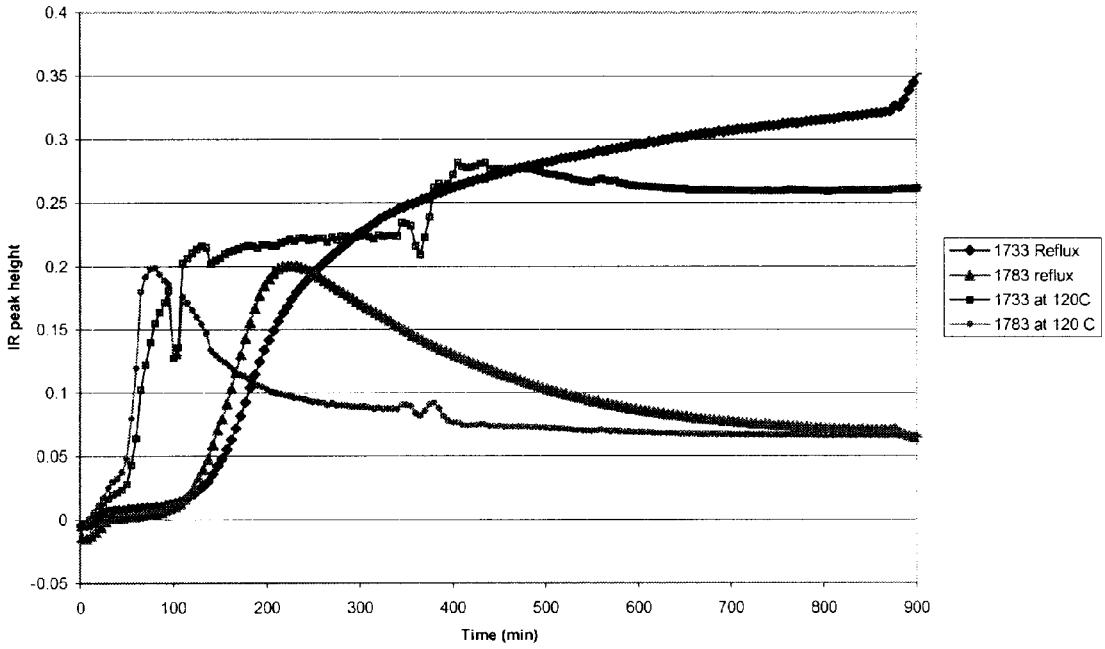
FIG. 2 is a graph illustrating polymer esterification over time (x-axis) with the y-axis being IR peak height.

The anhydride signal is 1783 $cm^{-1}$ and the ester signal is 1733 $cm^{-1}$ and can be followed relative to the baseline at 1598 $cm^{-1}$, as shown in FIG. 2. At the beginning of the reaction, there is no soluble material, and therefore, the IR signals are at zero. As the reaction progresses, the formation of acid groups allows the polymer to solubilize in the n-propanol, and the anhydride signal gradually decreases at the same time as the ester signal increases, until a final plateau is reached. At a reaction temperature of 120° C., about 6.5 hours were required to complete the reaction. Pressures observed during esterification were about 25–30 psi.

There are various commercial sources of IBMA that can be used for preparing the copolymer neutralizing layer. One source is Kuraray Co., Ltd, a Japanese company that distributes IBMA under the trade name ISOBAM (Kuraray America, Inc., 200 Park Avenue, New York, N.Y. 10166). Four molecular weight grades of the ISOBAM™ polymer were individually evaluated for use as the substrate for the formation of propyl half esters. The ISOBAM™ grades used were 600, 4, 6, and 10. After conversion to the propyl half-esters, gel permeation chromatography (GPC) measurements elucidated the molecular weight of the ester products, see Table 1. The samples were run on a Waters 150° C. instrument equipped with an external IR detector, using two PL Gel mixed bed columns and THF as the solvent at 1.0 mL/min. The number average molecular weight (Mn), weight average molecular weight (Mw), and polydispersity index ("PDI") (Mw/Mn) were determined.

The increase in molecular weight as compared to that of the anhydride copolymer IBMA corresponds to the ester content of the copolymer. It is slightly lower than expected based on the acid and solid content measurements and the disappearance of the anhydride resonances in the IR spectrum. It is conceivable that this is due to differences between the methods of the molecular weight measurements.

TABLE 1

| Sample | Ester | Anhydride (grade) | $M_n$ | $M_w$ | PDI | $M_w$* (initial) |
|---|---|---|---|---|---|---|
| 1 | Butyl | Isobam-6 | 49,400 | 112,000 | 2.27 | 80,000 |
| 4 | Propyl | Isobam-6 | 41,400 | 99,900 | 2.41 | 80,000 |
| 12 | Propyl | Isobam-4 | 31,000 | 75,000 | 2.42 | 55,000 |
| 16 | Propyl | Isobam-10 | 77,200 | 197,100 | 2.55 | 160,000 |

*weight average molecular weight of the anhydride copolymer (Isobam), reported by the supplier, Kuraray Co.

An initial set of reactions were conducted at atmospheric pressure (batches 1–4 and 10 in Table 2), which indicated that complete conversion was reached in n-butanol (batch 1 with a reflux temperature of 118° C.) in about 9 hours (theoretical acid value: 4.38 meq/g of polymer). See Table 2. When n-propanol was employed as the alcohol substrate (reflux temperature of 97° C.), the reaction time was about 13–14 hours (theoretical acid value: 4.67 meq/g). At elevated temperatures, like 120° C., conversion even with n-propanol, was practically complete within 6 hours.

There is an advantage in using n-propanol to form the neutralizing layer. The final reaction product, n-propyl half ester IBMA, can be used for direct coating. This ability to directly coat is advantageous in commercial manufacturing of a film unit. There are no intervening steps that could be costly to the manufacturing process.

Returning to Table 2, slight variations in reaction temperature had negligible influence on final conversion at a constant 6 hour reaction time (batches 14 and 15 compared to 11 and 12). A small amount of water (0.2% on total weight, or 6.9 mole percent on anhydride content) did not have any detectable effect on the acid content of the polymer (batch 13 compared to 11 and 12). Significant changes in agitation rate had a negligible effect on conversion or polymer properties (batches 8 and 9 compared to 6 and 7).

Batch to batch reproducibility under identical reaction conditions was very good (batches 3 and 4, 6 and 7, 11 and 12, 16 and 17). Reproducibility was equally good using a 30 kg reactor (Hastalloy pressure vessel, see batches 18–23), where reaction time was increased to 6.5 hours. The acid content of the copolymer under these conditions was even closer to the theoretical value (average of acid content of these batches was 4.60 meq/g).

Similar thermal behavior was observed with the butyl half ester of Isobam™–6, the butyl and pentyl half esters of EMA, and the butyl and hexyl half esters of Gantrez™ AN119, with small differences in the rates of reversion. (The slowest was the reversion of the butyl half ester of EMA, and the fastest was that of the propyl half ester of Isobam™–6.)

Figure 3:
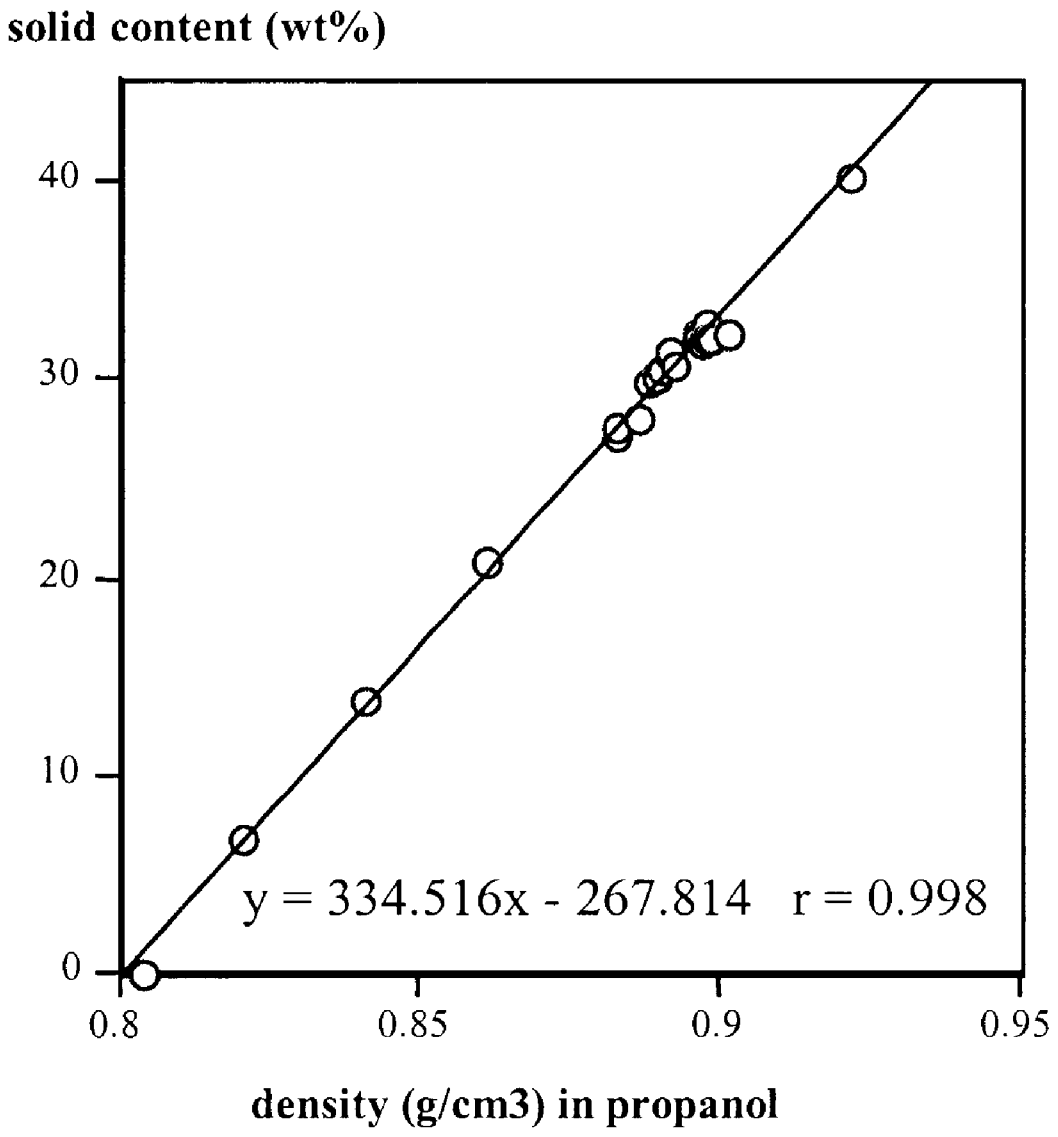
FIG. 3 is a graph showing the correlation between the density of the polymer solution in n-propanol and the polymer concentration.

A good linear correlation between the density of the Isobam™ polymer solution in n-propanol and the polymer concentration (expressed in weight percentage), shown in FIG. 3, allows one to obtain the polymer concentration within a few minutes. (In comparison, drying the samples to constant weight in the vacuum oven takes about two weeks.) Density of the solutions was determined using a calibrated Gardner cup of known volume. A Mettler-Paar DMA-45 density meter is also useful for this method.

TABLE 2

| Batch number | Isobam grade | Alcohol | Reaction temp. (° C.) | Reaction time (hr) | Agitation (rpm) | Solids (wt %) | Viscosity (cPs) | Density (g/cm$^3$) | Acid cont. (meq/g) |
|---|---|---|---|---|---|---|---|---|---|
| 1 | 6 | 1-BuOH | 118 | 9 | 175 | 25.77 | 412 | | 4.6 |
| 2 | 6 | 1-PrOH | 97 | 10 | 175 | 28.37 | 492 | | 5.44 |
| 3 | 6 | 1-PrOH | 97 | 13 | 175 | 28.06 | 466 | 0.8867 | 4.95 |
| 4 | 6 | 1-PrOH | 97 | 13 | 175 | 27.66 | 444 | 0.8830 | 4.98 |
| 5 | 6 | 1-PrOH | 120 | 6 | 150 | 27.05 | 397 | 0.8829 | 4.74 |
| 6 | 6 | 1-PrOH | 120 | 6 | 150 | 32.63 | 715 | 0.8979 | 4.94 |
| 7 | 6 | 1-PrOH | 120 | 6 | 150 | 31.92 | 830 | 0.8970 | 4.95 |
| 8 | 6 | 1-PrOH | 120 | 6 | 75 | 32.08 | 960 | 0.8979 | 5.03 |
| 9 | 6 | 1-PrOH | 120 | 6 | 300 | 32.16 | 868 | 0.8987 | 4.96 |
| 10 | 4 | 1-PrOH | 97 | 14 | 175 | 40.12 | 2285 | 0.9218 | 5.05 |
| 11 | 4 | 1-PrOH | 120 | 6 | 150 | 32.24 | 540 | 0.8960 | 4.87 |
| 12 | 4 | 1-PrOH | 120 | 6 | 150 | 32.07 | 499 | 0.8964 | 4.93 |
| 13 | 4 | 1-PrOH + $H_2O$ | 120 | 6 | 150 | 32.24 | 574 | 0.8994 | 4.79 |
| 14 | 4 | 1-PrOH | 117 | 6 | 150 | 32.12 | 463 | 0.8974 | 4.83 |
| 15 | 4 | 1-PrOH | 123 | 6 | 150 | 32.30 | 436 | 0.9018 | 4.68 |
| 16 | 10 | 1-PrOH | 120 | 6 | 150 | 30.13 | 2218 | 0.8894 | 4.80 |
| 17 | 10 | 1-PrOH | 120 | 6 | 150 | 30.31 | 2340 | 0.8891 | 5.01 |
| 18 | 10 | 1-PrOH | 120 | 6.5 | 140 | 30.39 | 2572 | 0.8899 | 4.82 |
| 19 | 10 | 1-PrOH | 120 | 6.5 | 140 | 29.87 | 2460 | 0.8877 | 4.73 |
| 20 | 10 | 1-PrOH | 120 | 6.5 | 140 | 30.52 | 3210 | 0.8903 | 4.48 |
| 21 | 10 | 1-PrOH | 120 | 6.5 | 140 | 31.30 | 3425 | 0.8918 | 4.53 |
| 22 | 10 | 1-PrOH | 120 | 6.5 | 140 | 31.09 | 2970 | 0.8917 | 4.52 |
| 23 | 10 | 1-PrOH | 120 | 6.5 | 140 | 30.63 | 3270 | 0.8924 | 4.54 |

Polymer concentration or solid content, shown in Table 2, was determined by drying the samples until constant weight was reached in a vacuum oven at room temperature. Determination of solid content by drying the polymer solution in a hot oven for extended time can give misleading results. The equilibrium, shown in reaction equation 1, is pushed to the left at high temperatures in the absence of alcohol (dry polymer), and the half ester reverts to the anhydride.

(1)

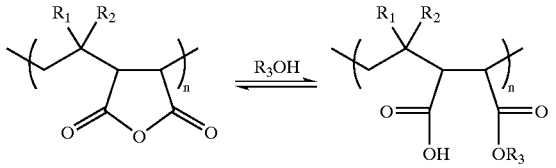

The polymer was stable at 50° C. and below, but slow weight loss was observed even at 70° C. Reversion to the anhydride was confirmed by IR measurements on solid polymer samples treated at 90° C. for 3 days. A continuous decrease of the acid and ester resonances at 1705 and 1730 1/cm and a simultaneous increase of the anhydride resonances at 1780 and 1850 1/cm was detected (the most rapid changes occurred during the first day of oven treatment).

The acid content, or acid value of the polymers, expressed in units of meq/g in Table 2 was determined by titration using sodium hydroxide. The polymer solution was diluted with n-propanol to approximately 2% by weight, and the solution was titrated using 0.1N sodium hydroxide solution. More concentrated solution of polymer or base caused the polymer to precipitate and/or partially hydrolyze to the diacid. The theoretical acid content of the propyl and butyl half ester of the IBMA copolymer are 4.67 and 4.38 meq/g, respectively, which is in good agreement with the acid values listed in Table 2.

The glass transition temperature (Tg) of the propyl half ester of Isobam™–10 polymer was determined by a TA Instrument 2920 Differential Scanning Calorimeter to be 65–68° C. (The inflection point in the reversible heat flow curve on the second heat was recorded as the Tg, samples were heated from −20° C. to 95° C. at 4° C./min.) It is necessary to keep the DSC temperature below 100° C. when analyzing the half ester polymers, to avoid reversion of the ester to anhydride, which would give an erroneously high Tg value. Thin, coated films of the polymer were found to be resistant to cracking and curling under standard testing conditions.

Viscosity of the polymer solutions in Table 2 were measured with a Brookfield viscometer at room temperature.

Selected polymer solutions were also blended with poly (vinyl butyral), commercially available under the trade name Butvar™ (grade B72), available from Monsanto, 800 Lindbergh Blvd, St. Louis, Mo. 63167. Shear thinning behavior of these blends was confirmed by viscosity measurements at high and low shear rates using a Bohlin VOR rheometer having a tapered plug geometry. Results are summarized in Table 3 for low (1 $sec^{-1}$) and high shear rates (10,000 $sec^{-1}$). The solutions are all shear thinning, but it is more pronounced in the blend with higher poly(vinyl butyral) content, and of the polymer of molecular weight.

TABLE 3

| Polymer | Butvar (wt %) | Viscosity (@ 1 $sec^{-1}$) | Viscosity (@ 10,000 $sec^{-1}$) |
|---|---|---|---|
| Propyl half-ester of Isobam-6 | 14.3 | 3,400 | 215 |
| Propyl half-ester of Isobam-6 | 20.0 | 6,500 | 258 |
| Propyl half-ester of Isobam-10 | 14.3 | 15,400 | 424 |

One of ordinary skill in the art will appreciate further features and advantages of the invention based on the above-described embodiments. Accordingly, the invention is not to be limited by what has been particularly shown and described, except as indicated by the appended claims.

What is claimed is:

1. A polymeric acid-reacting neutralizing layer in photographic film comprising a half ester of the copolymer isobutylene/maleic anhydride and a member selected from the group consisting of poly(vinyl butyral), titanium dioxide and mixtures thereof.

2. The neutralizing layer of claim 1, wherein the half ester is formed by a chemical reaction with an alcohol having between 1 to about 12 carbon atoms.

3. The neutralizing layer of claim 1, wherein the half ester is selected from the group consisting of propyl half ester and butyl half ester.

4. The neutralizing layer of claim 3, wherein the half ester is propyl half ester.

5. The neutralizing layer of claim 1, wherein the half ester of isobutylene/maleic anhydride has a $M_w/M_n$ ratio of about 1.5 to about 5.0.

6. The neutralizing layer of claim 1, wherein the half ester of the copolymer isobutylene/maleic anhydride has a molecular weight from about 50,000 to about 200,000 dalton.

7. A photographic film having an image-receiving element, comprising a polymeric acid-reacting neutralizing layer, wherein the neutralizing layer comprises a half ester of the copolymer isobutylene/maleic anhydride;

a timing layer, wherein the timing layer is adjacent to the neutralizing layer;

an image-receiving layer, wherein the image-receiving layer is adjacent to the timing layer; and a strip coat layer, wherein the strip coat layer is adjacent to the image-receiving layer.

8. The film of claim 7, wherein the strip coat layer is replaced with an overcoat layer.

9. The film of claim 7, wherein the half ester of the copolymer isobutylene/maleic anhydride is propyl half ester of the copolymer isobutylene/maleic anhydride.

10. A photographic film containing a photosensitive element, comprising:

a neutralizing system having an aqueous neutralizing layer and a barrier neutralizing layer, wherein the barrier neutralizing layer comprises a half ester of the copolymer isobutylene/maleic anhydride;

a timing layer, wherein the timing layer is adjacent to the barrier neutralizing layer; and a photosensitive layer, wherein the photosensitive layer is adjacent to the timing layer.

11. The photographic film of claim 10, wherein said half ester is formed by a chemical reaction with an alcohol having between 1 to about 12 carbon atoms.

12. The photographic film of claim 10, wherein said half ester of copolymer isobutylene/maleic anhydride is selected from the group consisting of propyl half ester and butyl half ester.

13. The film of claim 10, wherein the half ester of the copolymer isobutylene/maleic anhydride is propyl half ester of the copolymer isobutylene/maleic anhydride.

14. A method for neutralizing an alkaline processing solution in a photographic film, comprising contacting the alkaline processing solution with an acid-reacting neutralizing layer comprising a half ester of isobutylene/maleic anhydride copolymer and a member selected from the group consisting of poly(vinyl butyral), titanium dioxide and mixtures thereof.

15. The method of claim 14, wherein the half ester of isobutylene/maleic anhydride copolymer is propyl half ester of isobutylene/maleic anhydride copolymer.

* * * * *